US010384116B1

(12) United States Patent
Yeh

(10) Patent No.: US 10,384,116 B1
(45) Date of Patent: Aug. 20, 2019

(54) STEERING APPARATUS OF A SKATEBOARD

(71) Applicant: Jih-Wei Yeh, New Taipei (TW)

(72) Inventor: Jih-Wei Yeh, New Taipei (TW)

( * ) Notice: Subject to any disclaimer, the term of this patent is extended or adjusted under 35 U.S.C. 154(b) by 0 days.

(21) Appl. No.: 16/182,580

(22) Filed: Nov. 6, 2018

(51) Int. Cl.
*A63C 17/01* (2006.01)
*A63C 17/00* (2006.01)

(52) U.S. Cl.
CPC ..... *A63C 17/0093* (2013.01); *A63C 17/011* (2013.01); *A63C 17/012* (2013.01); *A63C 17/013* (2013.01)

(58) Field of Classification Search
CPC . A63C 17/0093; A63C 17/011; A63C 17/012; A63C 17/013
See application file for complete search history.

(56) References Cited

U.S. PATENT DOCUMENTS 2,822,182 A * 2/1958 Merbler ..... A63C 17/22 280/11.28
2,920,899 A * 1/1960 Crone ..... A63C 17/02 280/11.208
3,437,161 A * 4/1969 Ufford ..... A63C 17/01 180/11
4,054,297 A * 10/1977 Solimine ..... A63C 17/01 280/11.28
4,398,734 A * 8/1983 Barnard ..... A63C 17/01 280/11.28
5,330,214 A * 7/1994 Brooks ..... A63C 17/01 280/11.27
5,513,865 A * 5/1996 Brooks ..... A63C 17/01 280/11.27
6,286,843 B1 * 9/2001 Lin ..... A63C 17/0066 280/11.28
6,382,646 B1 * 5/2002 Shaw ..... B62K 3/002 280/11.28
6,398,238 B1 * 6/2002 Shaw ..... B62K 3/002 280/11.28
6,910,743 B2 * 6/2005 Cheng ..... B60B 11/00 280/124.174
6,981,710 B2 * 1/2006 Cheng ..... A63C 17/01 280/11.28
D620,847 S * 8/2010 Andrews ..... D12/159
(Continued)

FOREIGN PATENT DOCUMENTS

DE 102016107640 B3 * 7/2017 ..... A63C 17/01
WO WO-0197930 A2 * 12/2001 ..... A63C 17/01

*Primary Examiner* — Jacob B Meyer

(57) ABSTRACT

A steering apparatus includes a frame, a linkage, a pivot, a king pin assembly and two castors. The frame includes an extensive portion extending downward from a base plate. The linkage includes two connecting rods, a front hanger and a back hanger. The front hanger is pivotally connected to the connecting rods and includes a screw hole. The back hanger is pivotally connected to the connecting rods and includes an aperture. The pivot includes a smooth section inserted in a bore of the extensive portion and a threaded section inserted in the screw hole. The king pin assembly includes two bushings inserted in two ends of the aperture, two washers inserted in the ends of the aperture, and a king pin inserted in a cavity of the base plate, the aperture, the bushings and the washers, and then engaged with a nut. The castors are connected to the connecting rods.

8 Claims, 7 Drawing Sheets

(56) References Cited

U.S. PATENT DOCUMENTS

| | | | | |
|---|---|---|---|---|
| 7,988,159 | B2 * | 8/2011 | Chen | A63C 17/01 280/11.19 |
| 8,684,370 | B2 * | 4/2014 | Baumann | A63C 17/0093 280/11.27 |
| 8,888,108 | B1 * | 11/2014 | Beaty | A63C 17/012 280/11.27 |
| 8,985,602 | B2 * | 3/2015 | Chan | B62K 3/002 280/87.041 |
| 9,010,777 | B2 * | 4/2015 | Braden | A63C 17/012 280/11.28 |
| 9,381,968 | B2 * | 7/2016 | Chan | B62K 3/002 |
| 9,415,295 | B2 * | 8/2016 | Braden | A63C 17/012 |
| 9,498,701 | B2 * | 11/2016 | Baldauf | A63C 17/012 |
| 9,643,076 | B2 * | 5/2017 | Aamodt | A63C 17/015 |
| 9,744,433 | B2 * | 8/2017 | Baldauf | A63C 17/012 |
| 9,789,412 | B2 * | 10/2017 | Mainville | B62D 51/001 |
| 2002/0125670 | A1 * | 9/2002 | Stratton | A63C 17/01 280/87.041 |
| 2002/0135147 | A1 * | 9/2002 | Lee | A63C 17/01 280/87.041 |
| 2010/0044981 | A1 * | 2/2010 | Chen | A63C 17/01 280/11.19 |
| 2015/0224386 | A1 * | 8/2015 | Baldauf | A63C 17/012 280/124.103 |
| 2016/0206949 | A1 * | 7/2016 | Murphy | A63C 17/013 |
| 2017/0072290 | A1 * | 3/2017 | Baldauf | A63C 17/012 |
| 2018/0043236 | A1 * | 2/2018 | Baldauf | A63C 17/012 |

* cited by examiner

STEERING APPARATUS OF A SKATEBOARD

BACKGROUND OF INVENTION

1. Field of Invention

The present invention relates to a skateboard and, more particularly, to a steering apparatus of a skateboard.

2. Related Prior Art

A user sets a foot on a skateboard and kicks the ground or a floor to accelerate the skateboard or sets two feet on the skateboard while sliding. To control the course of the travel of the skateboard, the player tilts his or her body on the skateboard. Some users use skateboards for commuting. Some other users do kinds of tricks with skateboards for fun, competition and/or business.

To facilitate the maneuver of a skateboard, a steering apparatus is used. For example, U.S. Pat. No. 8,186,694 describes a conventional steering apparatus for a skateboard. The conventional steering apparatus is however bulky and complicated. Hence, it is difficult to assemble and maintain the conventional steering apparatus.

Taiwan Patent No. M303755 discloses another conventional steering apparatus for a skateboard 50. This steering apparatus includes a connecting unit 60, a supporting unit 10, two axles 20 and two castors 70. The connecting unit 60 includes a base plate 61 connected to the skateboard 50, a king pin 62 connected to the base plate 61, and two bushings 63 connected to the king pin 62. The bushings 63 are made of an elastic material. The supporting unit 10 includes a ring 11 that receives the bushings 63 and two apertures 13 that receive the axles 20. The castors 70 are connected to the axle 20. The steering of the skateboard 50 is caused by tilting the skateboard 50 relative to the supporting unit 10, the axles 20 and the castors 70. The tilting of the skateboard 50 relative to the supporting unit 10, the axles 20 and the castors 70 is caused by compression of the bushings 63. However, the tilting of the skateboard 50 relative to the supporting unit 10, the axles 20 and the castors 70 is limited because the extent to which the bushings 63 can be compressed is small and because the gap between the skateboard 50 and each of the castors 70 is small. Hence, the steering of the skateboard 50 is limited apparatus.

The present invention is therefore intended to obviate or at least alleviate the problems encountered in prior art.

SUMMARY OF INVENTION

It is the primary objective of the present invention to provide a skateboard with an efficient steering apparatus.

To achieve the foregoing objective, the steering apparatus A skateboard is provided with a steering apparatus that includes a frame, a linkage, a pivot, a king pin assembly, and two castor assemblies. The frame includes a base plate and an extensive portion. The base plate includes a cavity. The extensive portion extends downward from the base plate and includes a bore. The linkage is connected to the frame, and includes two connecting rods, a front hanger, and a back hanger. The front hanger is pivotally connected to the connecting rods and includes a screw hole. The back hanger is pivotally connected to the connecting rods and includes an aperture. The pivot includes a smooth section inserted in the bore and a threaded section inserted in the screw hole. The king pin assembly includes two bushings, two washers and a king pin. The bushings are respectively inserted in two ends of the aperture. The washers are respectively inserted in the ends of the aperture. The king pin is inserted in the cavity, the aperture, the bushings and the washers, and then engaged with a nut. Each of the castor assemblies includes a castor connected to one of the connecting rods.

Other objectives, advantages and features of the present invention will be apparent from the following description referring to the drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
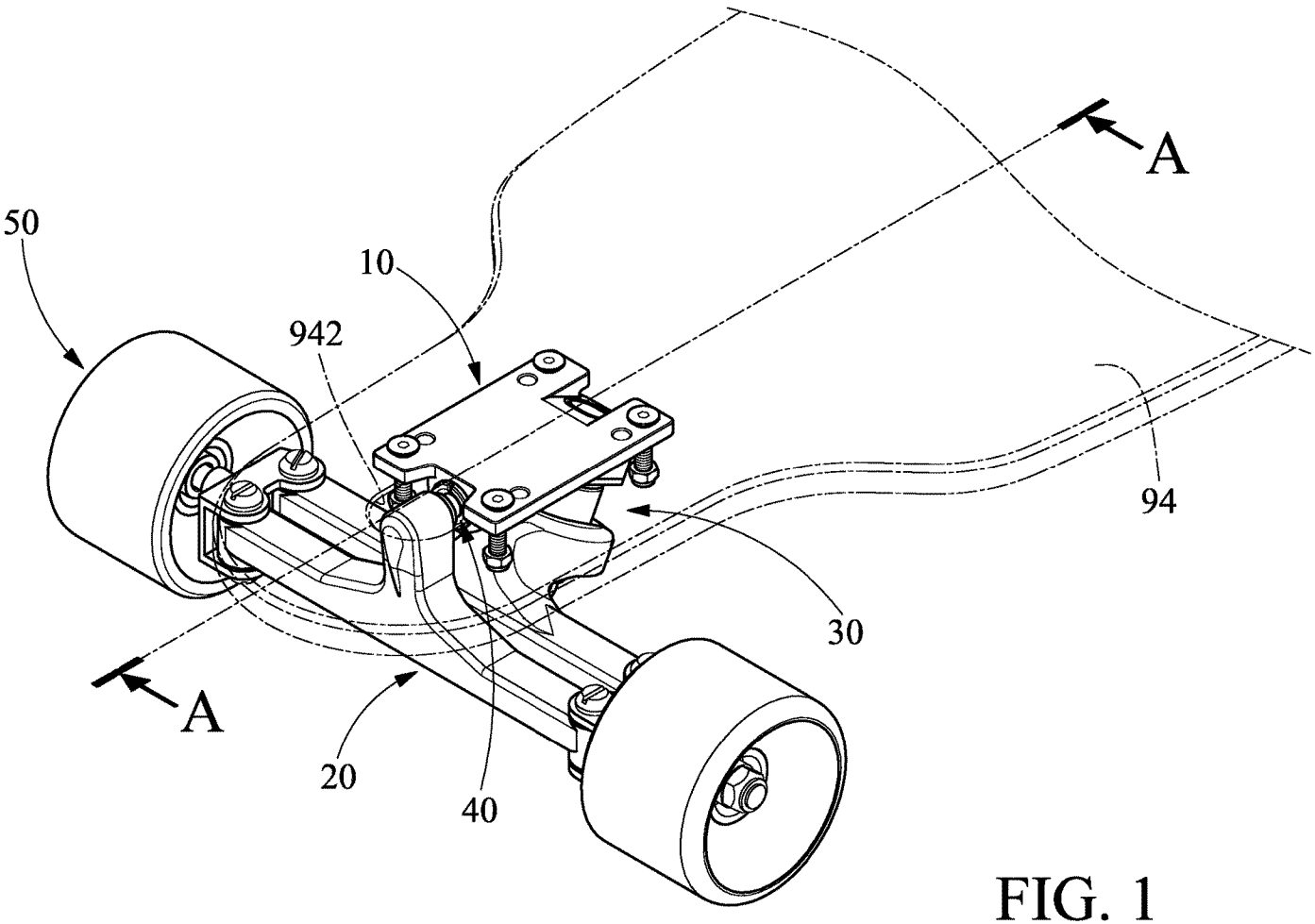
FIG. 1 is a perspective view of a skateboard provided with a steering apparatus according to the preferred embodiment of the present invention.

Referring to FIGS. 1 to 6, a skateboard is equipped with a steering apparatus according to the preferred embodiment of the present invention. The steering apparatus is connected to a board 94 of the skateboard. The steering apparatus includes a frame 10, a linkage 20, a king pin assembly 30, a pivot assembly 40 and two castor assemblies 50.

Referring to FIGS. 1 to 6, the frame 10 includes a base plate 12 made in one piece with an extensive portion 14. The extensive portion 14 extending downward from the base plate 12. Preferably, the base plate 12 extends parallel to the board 94

Referring to FIGS. 1 to 4, the linkage 20 includes a front hanger 21, a back hanger 22, and two connecting rods 23 and 24. The front hanger 21 extends parallel to the back hanger 22, and the front hanger 21 is located in front of the back hanger 22 (viewed from the left side to the right side in FIG. 1). Each of the first and back hangers 21 and 22 includes two ends connected to the connecting rods 23 and 24, thereby providing four-member linkage.

Referring to FIGS. 2, 3, 5 and 6, the king pin assembly 30 includes a cavity 31, an aperture 32, an upper restraining recess 33, a lower restraining recess 34, two bushings 35, two washers 36, a king pin 37, a nut 38, and a king sleeve 39.

The cavity 31 of the king pin assembly 30 extends throughout the extensive portion 14 of the frame 10.

The aperture 32 extends throughout the back hanger 22.

Figure 3:
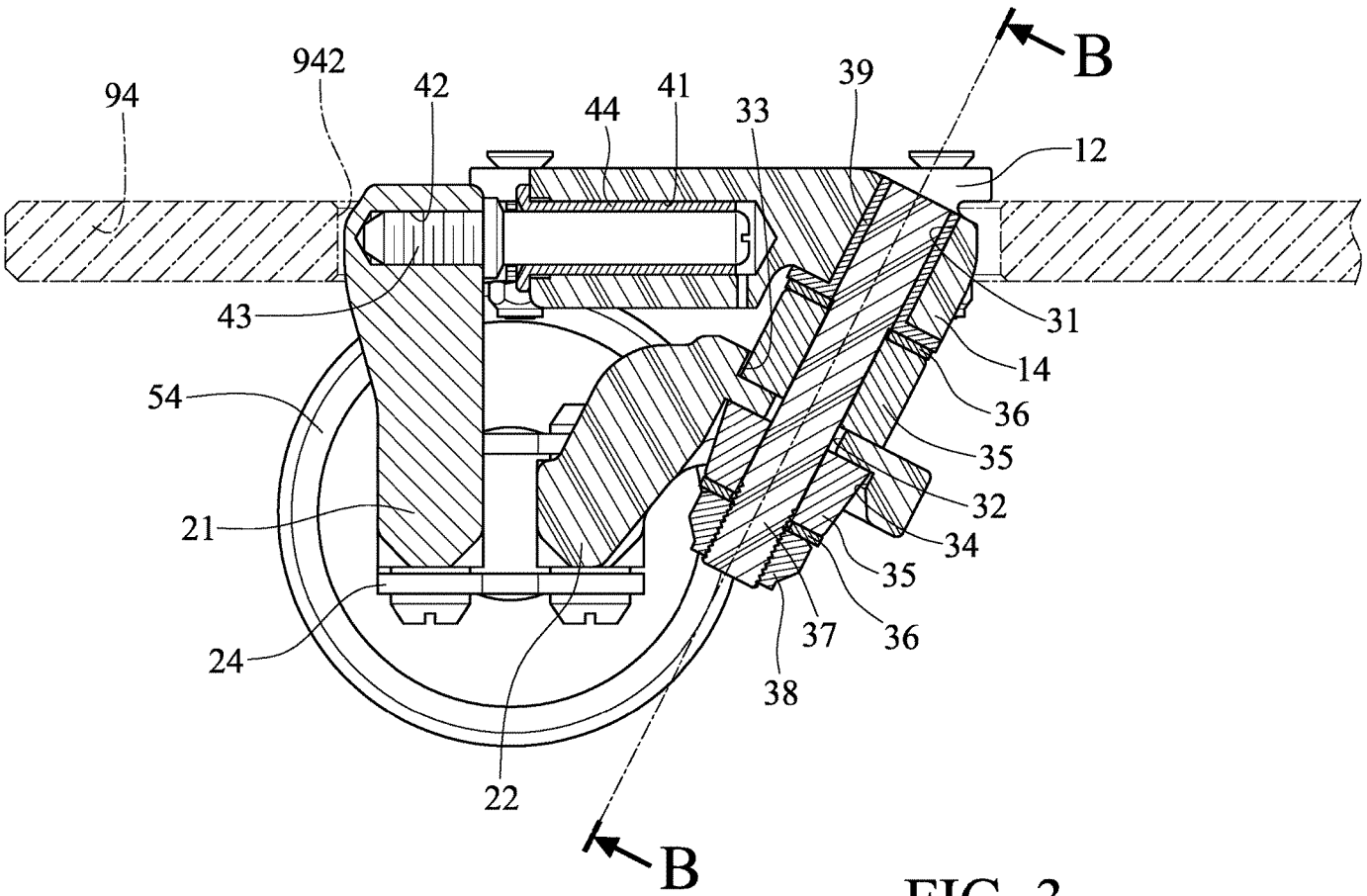
FIG. 3 is a cross-sectional view of the skateboard and the steering apparatus taken along a line A-A shown in FIG. 1.

Referring to FIG. 3, the upper restraining recess 33 is made in an upper face of the back hanger 22. The lower restraining recess 34 is made in a lower face of the back hanger 22. The upper and lower restraining recesses 33 and 34 are coaxial with the aperture 32.

The bushings 35 are made of an elastic material so that they can be compressed by a force and that they can recover their shapes when the force is removed. The bushings 35 and the washers 36 are overlapped corresponding to the upper and lower restraining recesses 33 and 34. Each of the bushings 35 abuts against a face in a corresponding one of the upper and lower restraining recesses 33 and 34.

The king pin 37 is inserted in the cavity 31 of the king pin assembly 30, the aperture 32, the bushings 35 and the washers 36 and then engaged with the nut 38 sequentially. The king pin 37 includes, at an end, thread 372 engaged with the nut 38 and includes, at another end, an enlarged head 374 with a diameter larger than that of the thread 372 of the king pin 37. Preferably, the enlarged head 374 is in the foim of a non-circular rod engaged with a non-circular wall of the cavity 31 of the king pin assembly 30 so that the king pin 37 is not rotatable relative to the king pin assembly 30 to allow tightening and loosening of the nut 38 with a single tool. The enlarged head 374 abuts one of the washers 36 and the nut 38 abuts the other washer 36, thereby compressing the bushings 35, which are inserted in the upper and lower restraining recesses 33 and 34. Moreover, there can be an angle of 10 to 50 degrees for example between the king pin 37 and the linkage 20, thereby increasing the entire length of the king pin 37 to increase an angle by which the board 94 can be tilted and a range in which the linkage 20 can be maneuvered.

The king sleeve 39 is provided between the king pin 37 and an annular portion of the king pin assembly 30 around the cavity 31. The king sleeve 39 can however be omitted in another embodiment. The non-circular wall of the cavity 31 of the king pin assembly 30 can be provided by the king sleeve 39.

Figure 4:
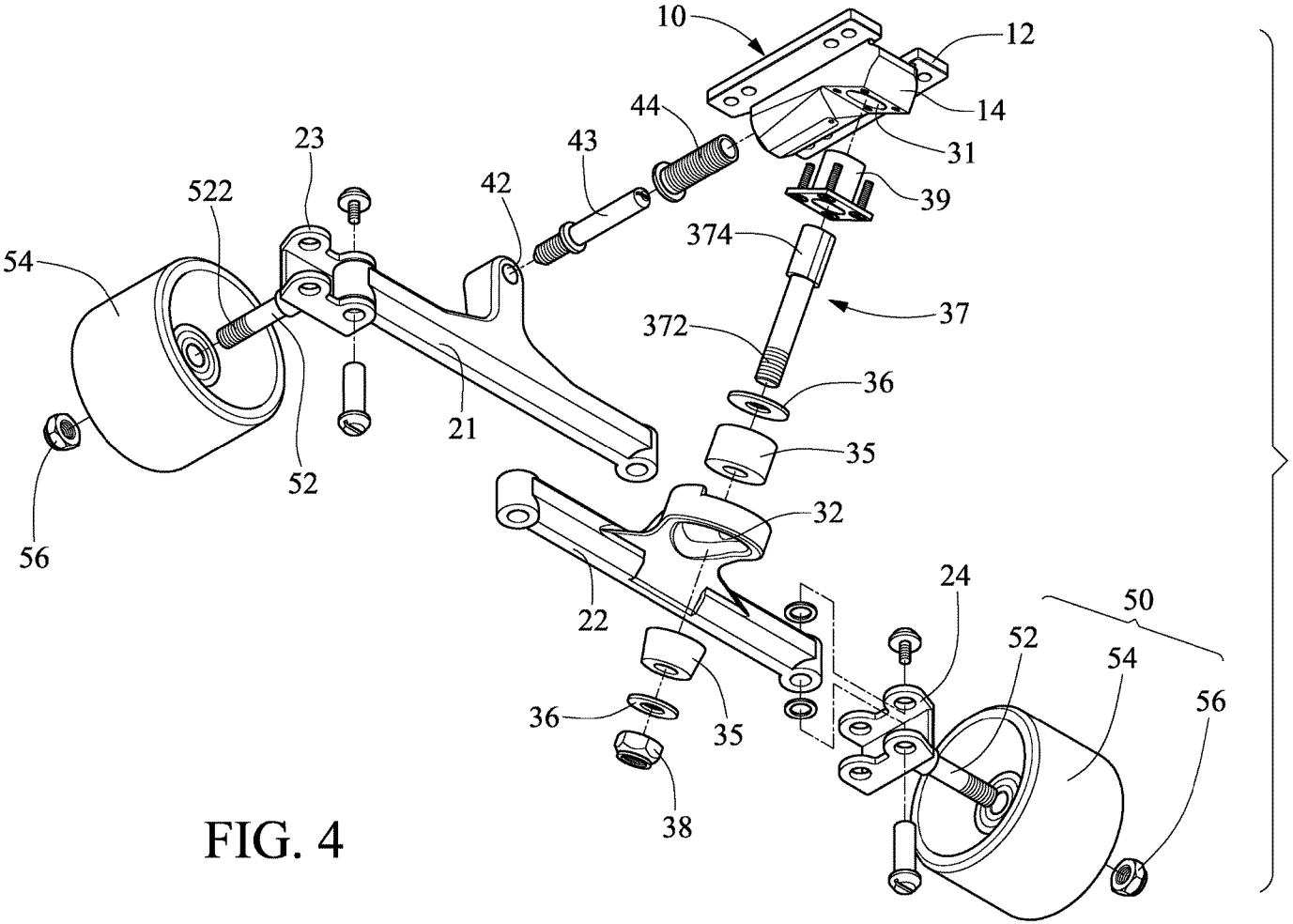
FIG. 4 is an exploded view of the steering apparatus shown in FIG. 1.
Figure 6:
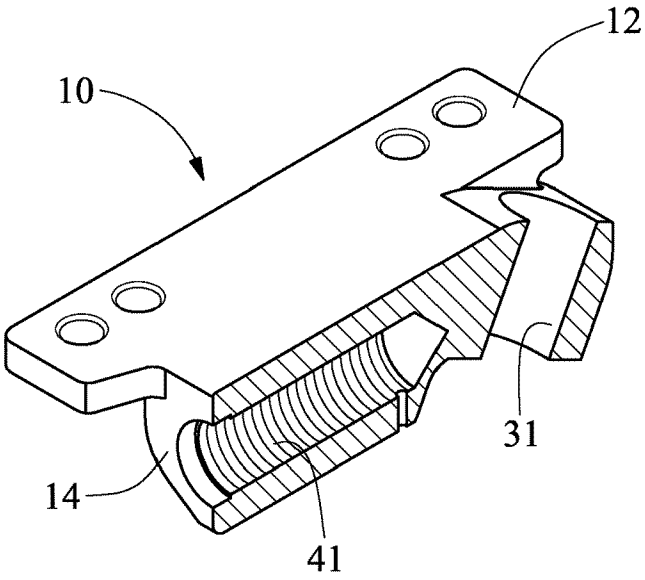
FIG. 6 is a cut-away view of the frame shown in FIG. 5.

Referring to FIGS. 1, 3 and 4, the pivot assembly 40 is pivotally connected to the frame 10 and engaged with the linkage 20. The pivot assembly includes a bore 41, a screw hole 42, a pivot 43, and a pivot sleeve 44.

The bore 41 is made in a proper location of the extensive portion 14 of the frame 10.

The screw hole 42 is made in a proper location in the front hanger 21 corresponding to the bore 41.

The pivot 43 includes a threaded section inserted in the screw hole 42 and a smooth section rotationally inserted in the bore 41. Preferably, the pivot 43 extends in a same sense of direction as the board 94, parallel to the base plate 12 of the frame 10.

The pivot sleeve 44 is located between a wall of the bore 41 and the pivot 43. The pivot sleeve 44 includes a thread engaged with a thread formed on the wall of the bore 41. In another embodiment, the pivot sleeve 44 can be omitted, and the bore 41 includes a smooth wall without any thread.

Figure 2:
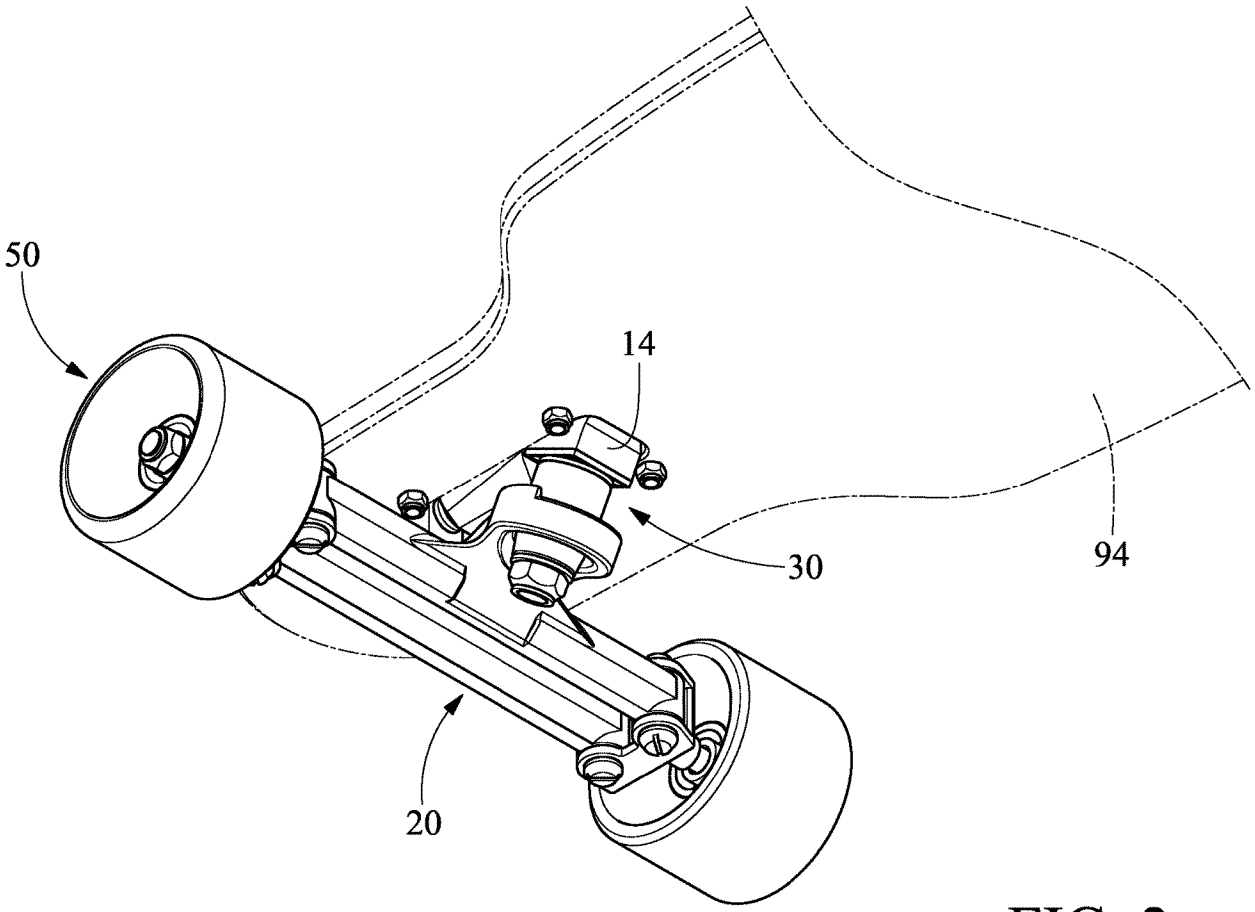
FIG. 2 is another perspective view of the skateboard and the steering apparatus shown in FIG. 1.
Figure 5:
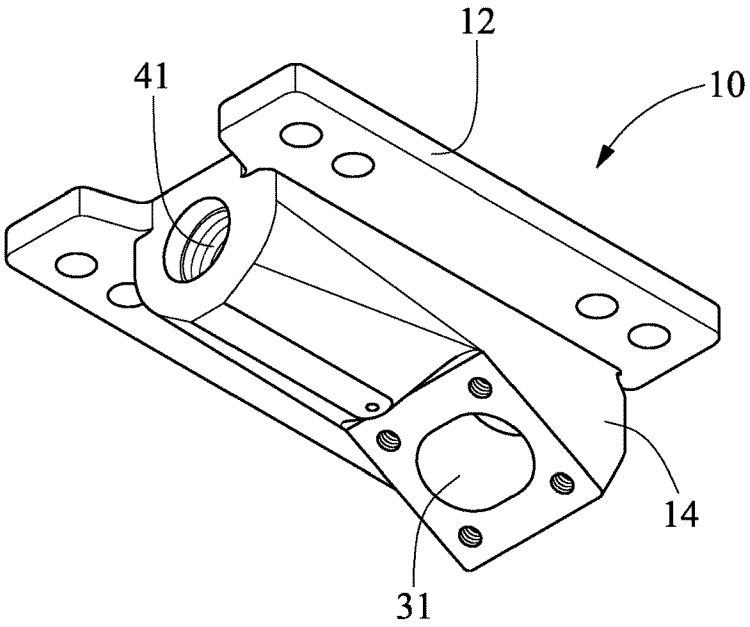
FIG. 5 is a perspective view of a frame of the steering apparatus shown in FIG. 1.
Figure 7:
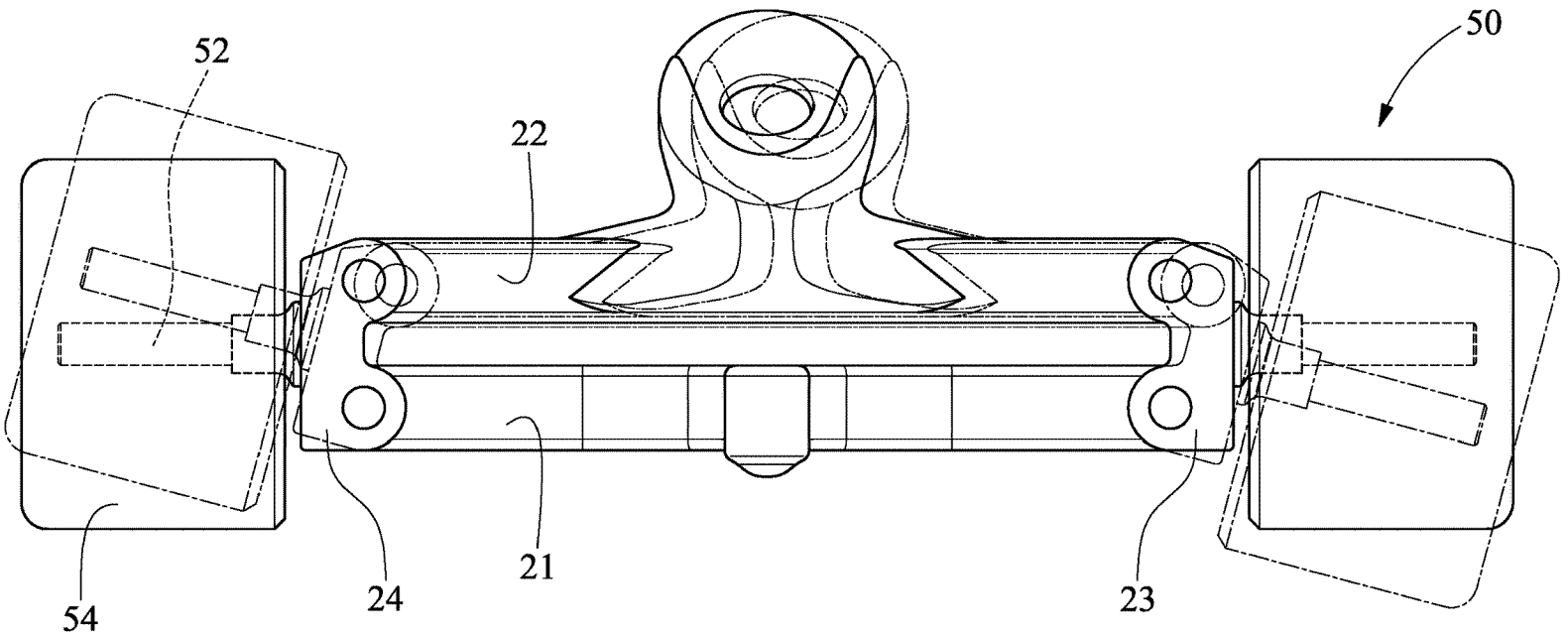
FIG. 7 is a rear view of the steering apparatus shown in FIG. 1.
Figure 8:
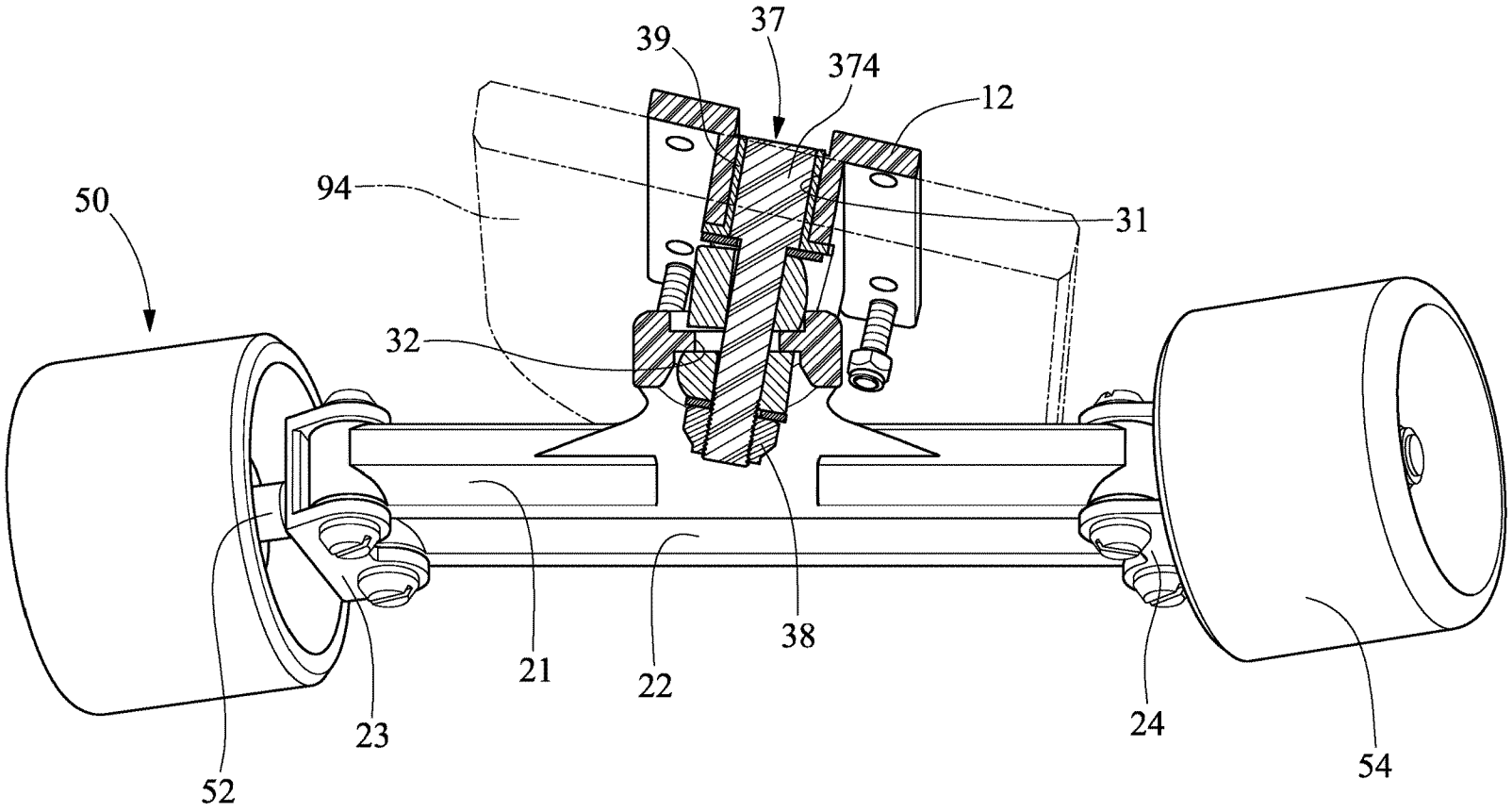
FIG. 8 is a cross-sectional view of the skateboard and the steering apparatus taken along a line B-B shown in FIG. 3.

Referring to FIGS. 1, 2 and 5, each of the castor assemblies 50 includes an axle 52, a castor 54 and a nut 56. The axle 52 includes an end connected to the connecting rod 23 or the connecting rod 24 at the right angle and another end formed with a thread 522. The castor 54 is provided around the axle 52. The nut 56 is engaged with the thread 522 of the axle 52 to restrain the castor 54. The castor 54 includes two square edges or two rounded edges.

Referring to FIG. 1, the board 94 includes at least one aperture 942 near a front or rear end. The aperture 942 extends throughout the board 94, from the top to the bottom. The extensive portion 14 of the frame 10 is inserted in the aperture 942. The aperture 942 can however be omitted in another embodiment, and the frame 10 can directly be attached to the bottom of the board 94 in such case.

The elements of the multi-connecting rod steering apparatus and their interconnection have been described above. The operation of the steering apparatus will be described.

Referring to FIGS. 1 to 8, a user of the skateboard sets a foot on the board 94 and uses the other foot to move and accelerate the skateboard. To turn the skateboard to a desired sense of direction, the user leans his or her body in the desired sense of direction, thereby moving his or her center of weight from a centerline of the board 94 in the desired sense of direction and accordingly tilts the board 94. Thus, the board 94 causes the frame 10 to pivot the king pin 37, and the enlarged head 374 of the king pin 37 compresses the bushing 35 inserted in the upper restraining recess 33. In addition, since the diameter of the aperture 32 is larger than that of the king pin 37, a lower section of the king pin 37 is moved to a side, and hence compresses the bushing 35 in the lower restraining recess 34, and moves the back hanger 22. For the interconnection of the hangers 21 and 22 and the connecting rods 23 and 24 of the linkage 20, the connecting rods 23 and 24 are forced to move, thereby causing the castor assemblies 50 to turn to the desired sense of direction.

When tilted, the king pin 37 compresses the bushings 35, and an upper end of the king pin 37 sinks deeper into the cavity 31 of the king pin assembly 30 because it is not restrained axially (in the direction of the extension of the king pin 37).

When the user stops exerting the force on the board 94, the bushings 35 recover their original shapes because of elasticity. Thus, the king pin 37 and the frame 10 are returned to their normal positions. Accordingly, the linkage 20 and the castor assemblies 50 are returned to their normal positions, thereby allowing the skateboard to move straight forward.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A skateboard-used steering apparatus comprising:

a frame (10) comprising:

a base plate (12) comprising a cavity (31); and an extensive portion (14) extending downward from the base plate (12) and comprising a bore (41);

a linkage (20) connected to the frame (10), and comprising:

two connecting rods (23, 24);

a front hanger (21) pivotally connected to the connecting rods (23, 24) at two ends and formed with a screw hole (42); and a back hanger (22) pivotally connected to the connecting rods (23, 24) at two ends and formed with an aperture (32) comprising upper and lower ends;

a pivot assembly (40) comprising a pivot (43) comprising a smooth section pivotally inserted in the bore (41) and a threaded section inserted in the screw hole (42);

a king pin assembly (30) comprising two bushings (35) respectively inserted in the upper and lower ends of the aperture (32), two washers (36) respectively inserted in the upper and lower ends of the aperture (32), and a king pin (37) inserted in the cavity (31), the aperture (32), the bushings (35) and the washers (36), and then engaged with a nut (38); and two castor assemblies (50) each of which comprises a castor (54) connected to a corresponding one of the connecting rods (23, 24).

2. The steering apparatus according to claim 1, wherein the pivot assembly (40) further comprises a pivot sleeve (44) located between a wall of the bore (41) and the pivot (43).

3. The steering apparatus according to claim 1, wherein the back hanger (22) further comprises an upper restraining recess (33) at the upper end of the aperture (32) and a lower restraining recess (34) at a lower end of the aperture (32), wherein the upper and lower restraining recesses (33, 34) are coaxial with the aperture (32).

4. The steering apparatus according to claim 1, wherein the king pin (37) extends at an angle from the linkage (20).

5. The steering apparatus according to claim 1, further comprising a king sleeve (39) between the king pin (37) and a wall of the cavity (31).

6. The steering apparatus according to claim 1, wherein the king pin (37) comprises an enlarged head (374) at an end corresponding to the cavity (31) of the king pin assembly (30), wherein the enlarged head (374) is in the form of a non-circular rod, corresponding to a non-circular wall of the cavity (31) of the king pin assembly (30), thereby preventing the king pin (37) from rotation in the cavity (31).

7. The steering apparatus according to claim 6, wherein the king pin (37) comprises, at an end opposite to the enlarged head (374), a thread (372) engaged with the nut (38).

8. The steering apparatus according to claim 1, wherein each of the castor assemblies (50) comprises:

an axle (52) comprising an end connected to a corresponding one of the connecting rod (23, 24) at an angle of 90 degrees and another end formed with a thread (522), wherein the castor (54) is located around the axle (52); and a nut (56) engaged with the thread (522) of the axle (52).

* * * * *